US005084376A

United States Patent [19]

Suda et al.

[11] Patent Number: 5,084,376

[45] Date of Patent: Jan. 28, 1992

[54] HEAT-DEVELOPABLE COLOR LIGHT-SENSITIVE MATERIAL

[75] Inventors: Yoshihiko Suda, Hachioji; Hidenobu Ohya, Hino; Kazuhiro Miyazawa; Tawara Komamura, both of Hachioji; Norio Miura, Hino, all of Japan

[73] Assignee: Konica Corporation, Tokyo, Japan

[21] Appl. No.: 701,563

[22] Filed: May 14, 1991

Related U.S. Application Data

[63] Continuation of Ser. No. 514,146, Apr. 25, 1990, abandoned.

[30] Foreign Application Priority Data

Apr. 30, 1989 [JP] Japan ..... 1-110767

[51] Int. Cl.[5] ..... G03C 1/34; G03C 5/54

[52] U.S. Cl. ..... 430/617; 430/203; 430/559; 430/611; 430/619; 430/955; 430/957

[58] Field of Search ..... 430/203, 559, 611, 617, 430/619, 955, 957

[56] References Cited

U.S. PATENT DOCUMENTS

| | | | |
|---|---|---|---|
| 4,689,286 | 8/1987 | Schranz et al. . | |
| 4,840,871 | 6/1989 | Peters et al. | 430/203 |
| 4,845,018 | 7/1989 | Sato et al. | 430/203 |

OTHER PUBLICATIONS

Abstract of Japanese Patent Publication No. 61-269147, dated Nov. 28, 1986, Fuji Photo Film Kabushiki Kaisha.

Abstract of Japanese Patent Publication No. 61-067851, dated Apr. 8, 1986, Fuji Photo Film Co., Ltd.

Abstract of U.S. Pat. No. 4,689,286, dated Aug. 25, 1987, Afga-Gevaert AG.

Abstract of Japanese Patent Publication No. 62-239148, dated Oct. 20, 1987, Fuji Photo Film Kabushiki Kaisha.

*Primary Examiner*—Charles L. Bowers, Jr.
*Assistant Examiner*—Thorl Chea
*Attorney, Agent, or Firm*—Finnegan, Henderson, Farabow, Garrett and Dunner

[57] ABSTRACT

There is disclosed a heat-developable color light-sensitive material having an excellent preservability and capable of providing images having a superior discrimination and only a slight fluctuation of Dmin against that of the development conditions. The material comprises a support having thereon a light-sensitive silver halide, a dye donor and a compound represented by following Formula I:

wherein X represents a group capable of splitting off in heat-development; Y represents the group of atoms necessary to form 5- or 6-membered heterocyclic ring; Z represents a substituent; and n represents an integer of 0 to 4.

28 Claims, No Drawings

HEAT-DEVELOPABLE COLOR LIGHT-SENSITIVE MATERIAL

FIELD OF THE INVENTION

The present invention relates to a heat-developable color light-sensitive material capable of forming a dye image by heat development, specifically to a heat-developable color light-sensitive material capable of forming a dye image by diffusibly transferring a dye.

BACKGROUND OF THE INVENTION

There are known the heat-developable light-sensitive materials capable of easily and rapidly providing a dye image in a thermal dry process, and such light-sensitive materials and image forming methods are described in Japanese Patent Examined Publication Nos. 4921/1968 and 4924/1968; the 'Silver Salt Photograph' section in 'Fundmental Photography' (Corona, 979) pp.553–555; and Research Disclosure 17029, pp. 9–15, June 1978.

Heat-developable light-sensitive materials are classified into a black-and-white type and a color type. Recently, an emphasis is put on a development of the heat-developable color light-sensitive materials capable of forming color images with various dye donors.

There are various types of heat-developable color light-sensitive materials. One example is a light-sensitive material in which a color image is formed by transferring a diffusible dye that is released or formed by heat development (hereinafter called a dye transfer type). Though this type of material requires an image receiving member for a transferred image, it is excellent in an image stability a sharpness and an easy and rapid processing. Such transfer type materials and the image forming methods therefor are described in Japanese Patent Publication Open to Public Inspection (hereinafter referred to as Japanese Patent O.P.I. Publication) Nos. 12431/1975, 159159/1984, 181345/1984, 229556/1984, 2950/1985, 52643/1986, 61158/1986, 61157/1986, 180550/1984, 132952/1986 and 139842/1986; and U.S. Pat. Nos. 4,595,652, 4,590,154 and 4,584,267.

The above conventional heat-developable light-sensitive material is liable to have a bad image discrimination. The solution for this problem is proposed in Japanese Patent O.P.I. Publication Nos. 301036/1988 and 301037/1988, in which there is disclosed an improvement of a developability of the light-sensitive material by adding a heterocyclic compound having a mercapto group. However, the image discrimination can not be improved sufficiently even with this technique, and there is left a problem of preservability deterioration attributable to the mercapto compound. In order to prevent the preservability deterioration, it has been required that the light-sensitive materials contain a development accelerator in the form of a stable precursor having a masked mercapto group.

Japanese Patent O.P.I. Publication No. 159642/1986 discloses a heat-developable light-sensitive material containing a coupler which releases a development accelerator by reacting with an oxidation product of a developing agent. This technique, however, can not provide a sufficient image density, and it is necessary to further improve the image discrimination by adding a stable development accelerater to a heat-developable color light-sensitive material.

Further, the conventional heat-developable color light-sensitive materials are liable to have a larger fluctuation of a minimum density of an image against fluctuations of the developing conditions, and therefore there has been a demand for a heat-developable color light-sensitive material having a further more excellent preservability.

SUMMARY OF THE INVENTION

It is the object of the present invention to provide the heat-developable color light-sensitive material having an excellent preservability and capable of giving an image with good discrimation and only a slight fluctuation of the minimum density against that of the developing conditions.

The above object can be accomplished by a heat-developable color light-sensitive material comprising a support having thereon at least a light-sensitive silver halide, a binder, a dye donor and a compound represented by the following Formula I.

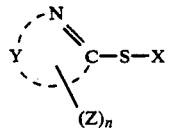

wherein X represents a group capable of splitting off upon nucleophilic substitution reaction in the heat-development; Y represents the group of atoms necessary to form 5- or 6-membered heterocyclic ring including the heterocyclic ring condensed with a hydrocarbon ring or a heterocyclic ring; Z represents a substituent; and n is an integer of 0 to 4.

DETAILED DESCRIPTION OF THE INVENTION

X represents an acyl, alkoxycarbonyl, aryloxycarbonyl, sulfonyl, carbamoyl, N-substituted carbamoyl, thiocarbonyl, thiocarbamoyl, N-substituted thiocarbamoyl, alkyl, —SR or —COSR group, wherein R is an alkyl group, an aryl group, a cycloalkyl group or a heterocyclic residue, provided that when R is a heterocyclic residue, it may be a

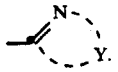

Z represents an organic group having not more than 13 carbon atoms, a halogen atom, a hydroxy group, a mercapto group, an amino group or a sulfamoyl group.

X may have a substituted of a ballast group. The ballast group is preferably an alkyl group which is selected so that the total carbon atoms contained in X are 13 to 40.

Examples of the ballast group are:

$$-C_{17}H_{33},\ -C_{15}H_{31},\ -C_{10}H_{21},\ -CH_2\underset{\underset{C_2H_5}{|}}{CH}-C_4H_9,$$

$$-(CH_2)_3O(CH_2)_7CH_3,\ -(CH_2)_3OCH_2\underset{\underset{C_2H_5}{|}}{CH}(CH_2)_8CH_3,$$

-continued

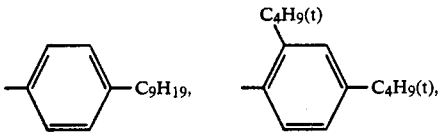

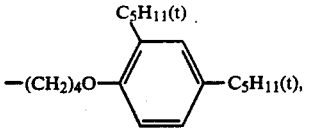

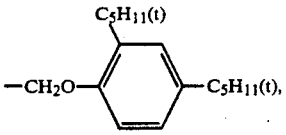

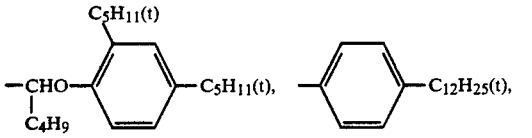

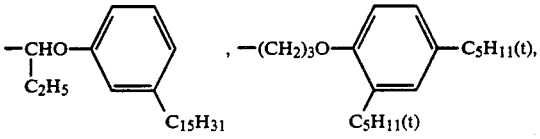

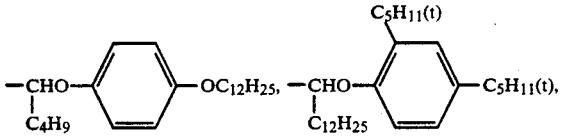

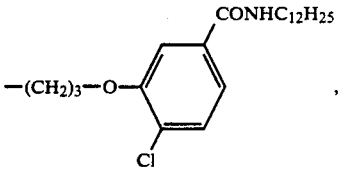

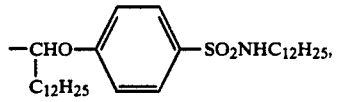

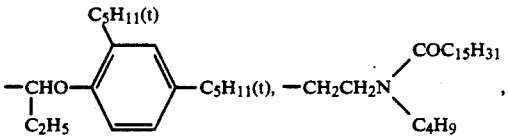

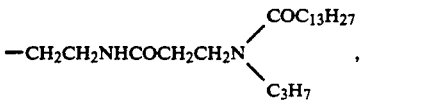

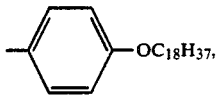

-continued

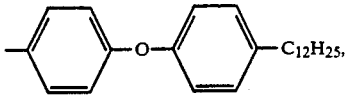

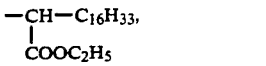

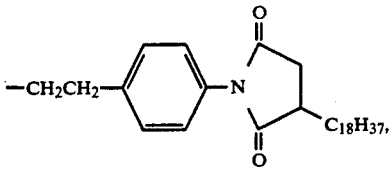

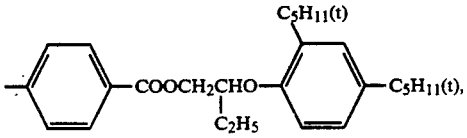

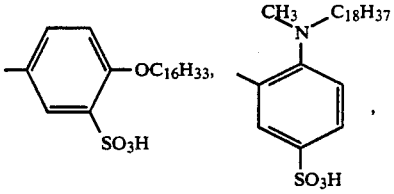

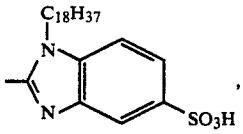

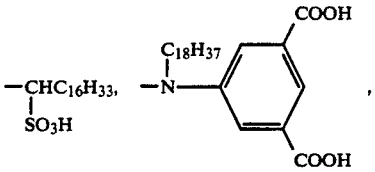

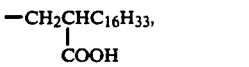

The organic group represented by Z is an alkyl, aryl, alkoxyl, aryloxy, alkylthio, arylthio, acyl, alkoxycarbonyl, N-sub- stituted amino, acylamino, carbamoyl, N-substituted carbamoyl, alkylsulfonyl, arylsulfonyl, alkylsulfonylamino, arylsulfonyl- amino, sulfamoyl, or cyano group.

The above groups may have substituents such as an alkyl group, an alkoxy group, an aryloxy group, an alkylthio group, an arylthio group, an acyl group, an alkoxycarbonyl group, an N-substituted amino group, an acylamino group, a carbamoyl group, an N-substituted carbamoyl group, an alkysulfonyl group, an arylsulfonyl group, an alkylsulfonylamino group, an arylsulfonylamino group, a sulfamoyl group, a cyano group, and a halogen atom.

Upon splitting off X in a heat development, the compound of Formula I releases photographically useful products such as a development inhibitor if the compound is a development precursor,and a development accelerator if it is a development accelerator precursor.

In order to achieve the objects of the invention, the compound of Formula I is preferably the development accelerator precursor (hereinafter referred to as the development accelerator precursor of the invention).

In the invention, the development accelerator is defined by a compound capable of improving heat developability; i.e., a compound capable of increasing a developed silver amount in the heat developing for a given period of time to thereby raise an image density.

The development accelerator is an organic compound of which silver salt has a solubility product of not more than $10^{-8}$, preferably not more than $10^{-10}$ in water of 25° C. and pH 9.6.

The compound of Formula I is represented preferably by the following Formulas II to IV.

Formula II

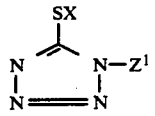

Formula III

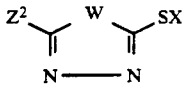

Formula IV

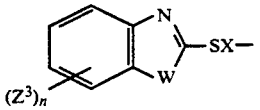

In Formulas II to IV, X and n are the same as those defined in Formula I; $Z^1$, $Z^2$ and $Z^3$ are the same as those defined for Z in Formula I; and W represents an oxygen or sulfur atom or an imino group.

$Z^1$ is represented preferably by

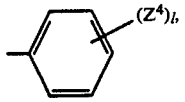

wherein $Z^4$ is a hydrogen atom, a halogen atom, an alkyl, alkoxy, aryloxy, alkylthio, arylthio, acyl, alkoxycarbonyl, N-substituted amino, acylamino, carbamoyl, N-substituted carbamoyl, alkylsulfonyl, arylsulfonyl, alkylsulfonylamino, arylsulfonylamino, sulfamoyl, cyano or carboxyl group, and l is an integer of zero to 4.

The carbon atoms of $Z^2$ or $Z^3$ are preferably not more than 7, and more preferably not more than 5. Those of $Z^4$ are preferably not more than 5.

Among the compounds represented by Formulas II to IV, the compound represented by Formula IV is more preferable, in which W is further more preferably an imino group.

The following are the examples of the development accelerator precursor of the invention.

The compounds of Formula II:

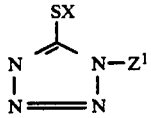

| Compound No. | X | $Z^1$ |
|---|---|---|
| II-1 | 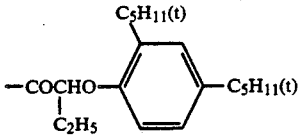 | 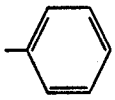 |
| II-2 | 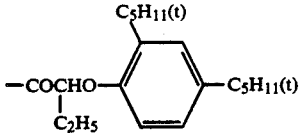 | 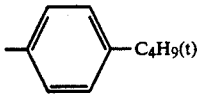 |
| II-3 | 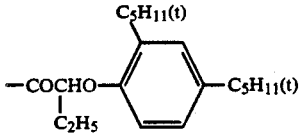 | 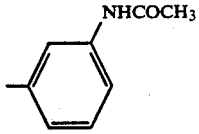 |
| II-4 | 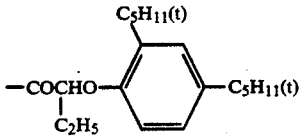 | 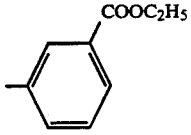 |
| II-5 | 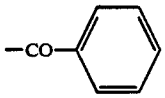 | 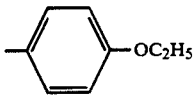 |

-continued
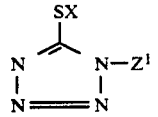
| Compound No. | X | $Z^1$ |
|---|---|---|
| II-6 | 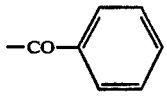 | $-C_3H_7(n)$ |
| II-7 | $-COOC_2H_5$ | 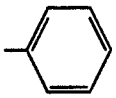 |
| II-8 | 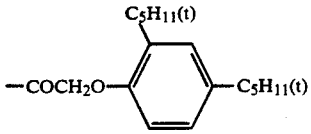 | 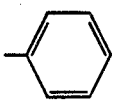 |
| II-9 | 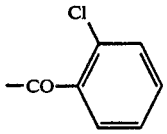 | 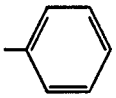 |
| II-10 | 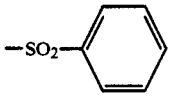 | 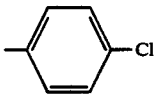 |
| II-11 | 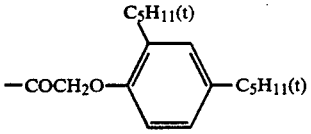 | 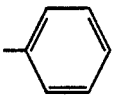 |
| II-12 | 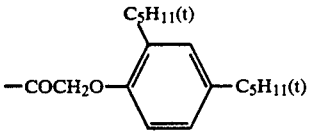 | 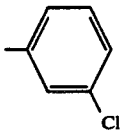 |
| II-13 | $-COC_4H_9(t)$ | 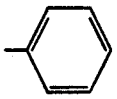 |
| II-14 | $-COOC_{16}H_{33}$ | 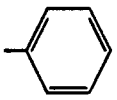 |
| II-15 | 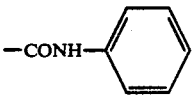 | 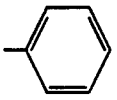 |
| II-16 | 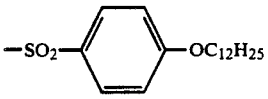 | 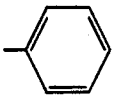 |

-continued
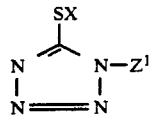
| Compound No. | X | $Z^1$ |
|---|---|---|
| II-17 | 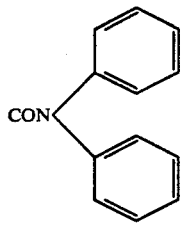 | 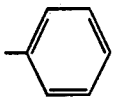 |
| II-18 | 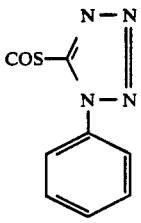 | 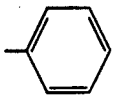 |
| II-19 | $-SC_{10}H_{21}$ | 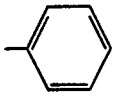 |
| II-20 | $-CSN(C_2H_5)_2$ | 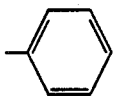 |
| II-21 | 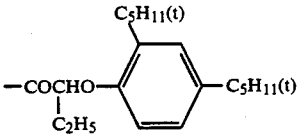 | 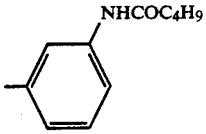 |
| II-22 | 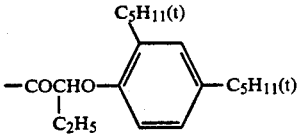 | 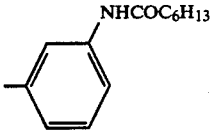 |
The compounds of Formula III:
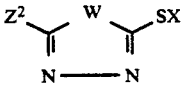
| Compound No. | X | W | $Z^2$ |
|---|---|---|---|
| III-1 | 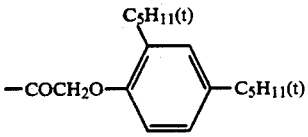 | S | $-SC_3H_7$ |

-continued
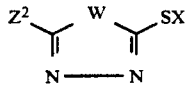
| Compound No. | X | W | $Z^2$ |
|---|---|---|---|
| III-2 | 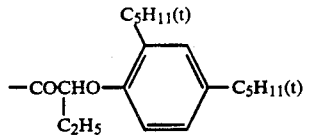 | S | $-SC_3H_7$ |
| III-3 | 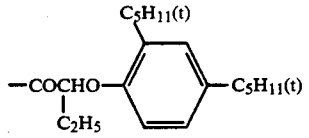 | S | $-SCH_2CN$ |
| III-4 | 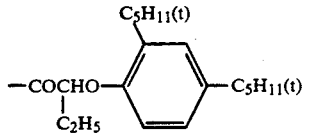 | S | $-NHCOCH_3$ |
| III-5 | 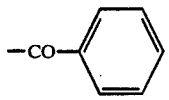 | S | $-C_4H_9(n)$ |
| III-6 | 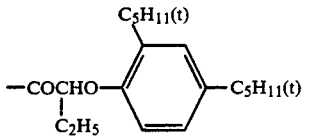 | O | $-SC_3H_7$ |
| III-7 | 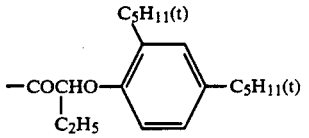 | O | $-SCH_2CN$ |
| III-8 | 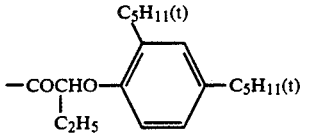 | NH | $-NHCOCH_3$ |
| III-9 | 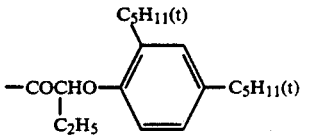 | NH | $-CH_3$ |
| III-10 | 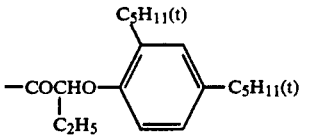 | S | 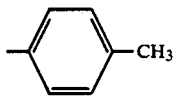 |
| III-11 | 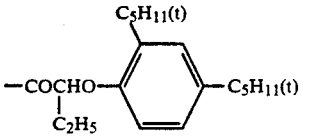 | S | 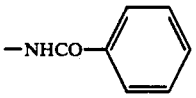 |
| III-12 | $-COOC_{16}H_{33}$ | S | $-SCH_2CH_2COOC_2H_5$ |

-continued
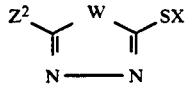
| Compound No. | X | W | $Z^2$ |
|---|---|---|---|
| III-13 | 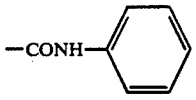 | S | $-SCH_2CH_2OH$ |
| III-14 | 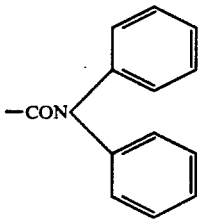 | S | $-NHCOCH_3$ |
| III-15 | 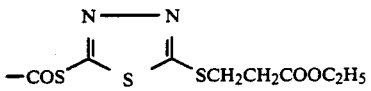 | S | $-SCH_2CH_2COOC_2H_5$ |
| III-16 | 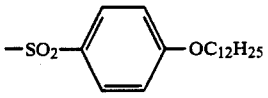 | S | $-NHCOOC_2H_5$ |
| III-17 | $-SC_{10}H_{21}$ | S | $-NHCOCH_3$ |
| III-18 | $-CSN(C_2H_5)_2$ | S | $-NHCOOC_2H_5$ |
The compounds of Formula IV:
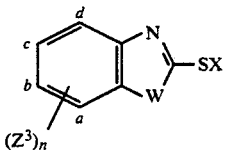
| Compound No. | X | W | Position of $Z^3$ | $Z^3$ |
|---|---|---|---|---|
| IV-1 | $-COCH_3$ | NH | — | — |
| IV-2 | 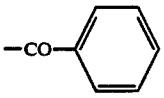 | NH | — | — |
| IV-3 | $-COOC_2H_5$ | NH | b | $-OCH_3$ |
| IV-4 | 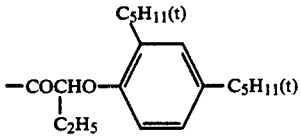 | S | — | — |
| IV-5 | 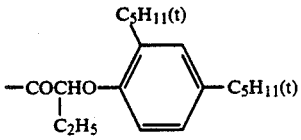 | O | — | — |
| IV-6 | $-COCH_3$ | S | — | $-OC_2H_5$ |

-continued
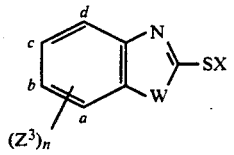
| Compound No. | X | W | Position of $Z^3$ | $Z^3$ |
|---|---|---|---|---|
| IV-7 | 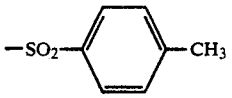 | NH | b | $-C_2H_5$ |
| IV-8 | 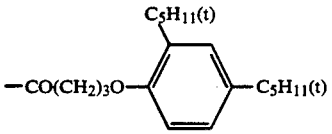 | NH | b | $-OC_2H_5$ |
| IV-9 | 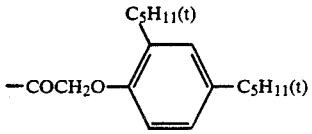 | NH | — | — |
| IV-10 | 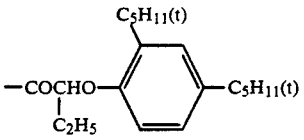 | NH | — | — |
| IV-11 | 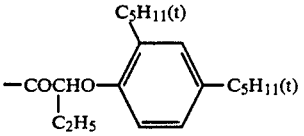 | NH | b | $-OC_2H_5$ |
| IV-12 | 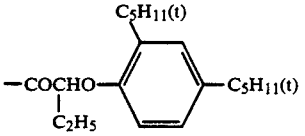 | NH | b | $-OC_4H_9(n)$ |
| IV-13 | 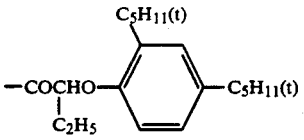 | NH | b | $-C_3H_7(n)$ |
| IV-14 | 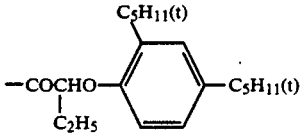 | NH | b | $-OC_5H_{11}$ |
| IV-15 | 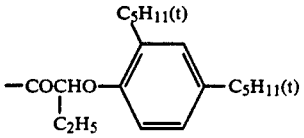 | NH | b | $-OC_7H_{15}$ |
| IV-16 | $-COC_3H_7$ | O | b | $-Cl$ |
| IV-17 | $-COOC_5H_{11}$ | NH | b | $-CH_3$ |
| | | | c | $-CH_3$ |

-continued
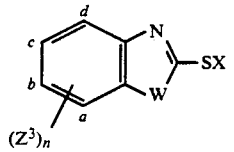
| Compound No. | X | W | Position of $Z^3$ | $Z^3$ |
|---|---|---|---|---|
| IV-18 | 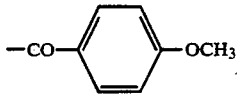 | O | b | —Cl |
| IV-19 | $-COOC_4H_9(t)$ | NH | a | $-CF_3$ |
| IV-20 | $-SO_2CH_3$ | NH | b | —Cl |
| IV-21 | 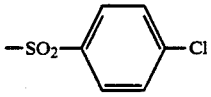 | S | c | —Cl |
| IV-22 | $-CONHCH_2Cl$ | S | b | $-NHCOC_3H_7$ |
| IV-23 | $-COOC_{16}H_{33}$ | S | — | — |
| IV-24 | 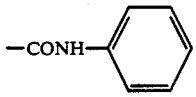 | S | — | — |
| IV-25 | 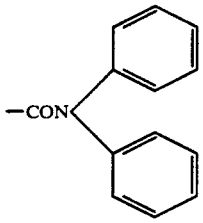 | S | b | —Cl |
| IV-26 | 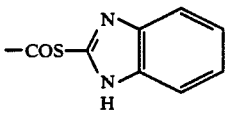 | S | — | — |
| IV-27 | 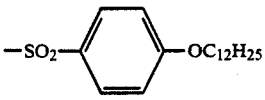 | NH | c | —Cl |
| IV-28 | $-SC_{10}H_{21}$ | NH | b | $-OC_2H_5$ |
| IV-29 | $-CSN(C_2H_5)_2$ | NH | — | — |
| IV-30 | 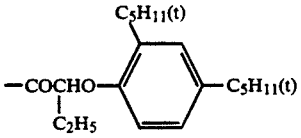 | NH | b | $-NH_2$ |
| IV-31 | 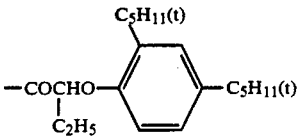 | NH | b<br>c | —Cl<br>—F |

-continued

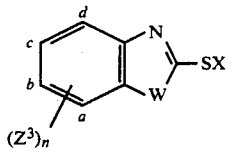

| Compound No. | X | W | Position of $Z^3$ | $Z^3$ |
|---|---|---|---|---|
| IV-32 | 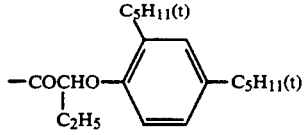 | O | c | 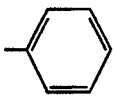 |

Next, some synthesis examples of the development accelerator precursors of the invention are described below:

Synthesis-1: Compound IV-2

2-mercaptobenzimidazole 20 g, pyridine 12 ml and acetonitrile 100 ml with stirring at room temperature. After stirring for 3 hours at room temperature, the reaction mixture was poured into a dilute hydrochloric acid solution, and the solution was filtered to obtain a solid. This solid was dissolved in ethyl acetate by heating and then cooled by ice to obtain the precipitated solid (objective substance) by filtration. Yield: 21 g.

Synthesis-2: Compound IV-10

A mixture of 2-mercaptobenzimidazole 20 g, pyridine 12 ml and acetonitrile 100 ml was heated and stirred at 50° C., and then, α-(2,4-di-t-amylphenoxy)-butyric chloride 45 g was added dropwise. After stirring for 4 hours, the reaction mixture was poured into 600 ml of a dilute hydrochloric acid solution, and extracted with ethyl acetate. The ethyl acetate layer was dried with magnesium sulfate, and then ethyl acetate was distilled off. The residual resin-like substance was crystallized in hexane, whereby crude crystals were obtained. The crude crystals were recrystallized in acetonitrile to thereby obtain 32 g of an objective substance.

The development accelerator precursor of the invention may be used alone or in combintaion. An addition amount thereof is preferably 0.1 millimole to 2 mole per mole of silver halide, and more preferably 1 millimole to 200 millimole.

The development accelerator precursor of the invention is incorporated into the heat-developable color light-sensitive material by a conventional method; for example, a solution of the precursor dissolved in a low-boiling solvent such as methanol, ethanol or ethyl acetate, or a high-boiling solvent such as dibutyl phthalate, dioctyl phthalate or tricresyl phosphate, is dispersed by an ultrasonic dispersion method or dispersed together with an appropriate polymer aqueous solution such as polyvinyl butyral or polyvinyl pyrrolidone by means of a ball mill, and then the dispersion is incorporated into the light-sensitive material.

A development accelerator can be released from a development accelerator precursor preferably by a nucleophilic substitution reaction in heat development, wherein there can be used the conventional nucleophilic agents including a hydroxy ion, a halogen ion and an amine radical. In the invention, the nucleophilic agent is preferably a compound having an amino group, more preferably a color developing agent.

The dye donors used for the heat-developable color light-sensitive material of the invention are couplers to form nondiffusible dyes described in Japanese Patent O.P.I. Publication Nos. 44737/1987, 129852/1987 and 169158/1987; a leuco dye described in U.S. Pat. No. 475,441; and an azo dye used in the heat-developable dye bleaching method described in U.S. Pat. No. 4,235,957. The dye donor is preferably of a diffusion type in which a diffusible dye is formed or released, and more preferably a compound to form a diffusible dye upon coupling reaction.

The diffusion type dye donor is a compound capable of forming or releasing a diffusible dye upon a reduction reaction of a light-sensitive silver halide and/or an organic silver salt and is classified to negative-type and positive type dye donors according to the reaction forms thereof.

Examples of the negative-type dye donor are the reductive dye-releasing compounds described in U.S. Pat. Nos. 4,463,079 and 4,439,513; and Japanese Patent O.P.I. Publication Nos. 60434/1984, 65839/1984, 71046/1984, 87450/1984, 88730/1984, 123837/1984, 124329/1984, 165054/1984 and 164055/1984.

Different examples of the negative-type dye donor are the coupling dye-releasing compounds described in U.S. Pat. No. 4,474,867; and Japanese Patent O.P.I. Publication Nos. 12431/1984, 48765/1984, 174834/1984, 776642/1984, 159159/1984 and 231040/1984.

The negative-type dye donor is represented preferably by the following Formula (a):

Cp—(J)—(B)

wherein Cp is a coupler residue capable of forming a diffusible dye upon a coupling reaction with an oxidation product of a reducing agent; J is a divalent linkage group connected to an active site of Cp at which Cp reacts with the oxidation product of a reducing agent; and B is a ballast group. The ballast group serves for preventing the dye donor from substantially diffusing during heat development, and is a group capable of exerting its function by a function of the group such as a sulfo group, or by a size of the group such as a group having a large number of carbon atoms. The coupler residue represented by Cp has a molecular weight of preferably not more than 700, and more preferably not more than 500 in order to improve the diffusibility of the dye formed.

The ballast group has 8 or more carbon atoms, preferably 12 or more carbon atoms, and is more preferably a polymer chain.

The coupling dye-forming compound having a polymer chain group comprising repetitive units of monomers is represented by the following Formula (b):

$$Cp—(J)—(Y)_l—(Z)—(L)$$

wherein Cp and J are the same as defined in Formula (a); Y is an alkylene group, an arylene group or an aralkylene group; l is an integer of zero or 1; Z is a divalent organic group; and L is an ethylenically unsaturated group or a group having an ethylenically unsaturated group.

Examples of the coupling dye forming compounds represented by Formulas (a) and (b) are described in Japanese patent O.P.I. Publication Nos. 124339/1984, 181345/1984, 2950/1985, 57943/1986 and 59336/1986; and U.S. Pat. Nos. 4,631,251, 4,650,748 and 4,656,124. Particularly, the polymer-type dye donors described in U.S. Pat. Nos. 4,656,124, 4,631,251 and 4,650,748 are preferred.

Examples of the positive-type dye donor are the compounds described in Japanese Patent O.P.I. Publication Nos. 55430/1984, 165054/1984, 154445/1984, 766954/1984, 116655/1984, 124327/1984 and 152440/1984.

These dye donors may be used alone or in combination. An addition amount thereof is 0.005 to 50 g/m$^2$, and preferably 0.1 g to 10 g/m$^2$.

The dye donor can be incorporated into the photographic component layers by a conventional method; for example, a solution of the dye donor dissolved in a low-boiling solvent such as methanol, ethanol or ethyl acetate and/or a high-boiling solvent such as dibutyl phthalate, dioctyl phthalate or tricresyl phosphate is dispersed in emulsion, or dissolved in an alkalline aqueous solution and then neutralized with an acid, or dispersed in an aqueous solution of a polymer such as gelatin, polyvinylbutyral or polyvinylpyrrolidone.

The light-sensitive silver halide used in the invention may be conventional one such as silver chloride, silver bromide, silver iodide, silver chlorobromide, silver chloroiodide and silver iodobromide. The silver halide can be prepared in any manner generally used in the photographic art.

There may be used an emulsion containing the silver halide grains having a multilayered structure in which a core and a shell have the different silver halide compositions changing stepwise or continuously.

The configuration of the light-sensitive silver halide grains may or may not be of a specific crystal habit such as cube, sphere, octahedron, dodecahedron or tetradecahedron. Such silver halide grains are described in Japanese Patent O.P.I. Publication No. 215948/1985.

There may be used a silver halide emulsion containing tabular grains described in Japanese Patent O.P.I. Publication 111933/1983, 111934/1984 and 108526/1984, and Research Disclosure 22534.

Further, there may be used a silver halide emulsion containing an internal latent image-type silver halide grain of which surface is not prefogged, as described in U.S. Pat. Nos. 2,592,250, 3,206,313, 3,317,322, 3,511,622, 3,447,927, 3,761,266, 3,703,584 and 3,736,140. There may also be used silver halide grains containing multivalent metallic ions as described in U.S. Pat. Nos. 3,271,157, 3,447,927 and 3,531,291; silver halide grains containing a doping agent, of which surface is weakly chemically sensitized, as described in U.S. Pat. No. 3,761,276; silver halide grains having a multilayered structure as described in Japanese Patent O.P.I. Publication Nos. 8524/1975 and 38525/1975; and silver halide emulsion as described in Japanese Patent O.P.I. Publication Nos. 156614/1977 and 127549/1980.

The grain size of the silver halide is preferably about 0.005 μm to 1.5 μm, and more preferably about 0.01 μm to 0.5 μm.

In the invention, the light-sensitive silver halide can be prepared by mixing a light-sensitive silver salt-forming component with an organic silver salt to form the light-sensitive silver halide as portion of the organic silver salt.

These light-sensitive silver halide and light-sensitive silver salt-forming components are used in an amount per layer of preferably 0.001 g to 50 g, and more preferably 0.1 to 10 g/m$^2$.

The silver halide emulsion may be chemically sensitized by a conventional method.

The silver halide emulsion may be spectrally sensitized with known sensitizing dyes to blue, green, red and near infrared light.

Typical sensitizing dyes are cyanine, merocyanine, complex (tri- or tetranucleo) cyanine, holopolar cyanine, styryl, hemicyanine and oxonol dyes.

The adding amount of these sensitizing dyes is preferably $1\times10^{-6}$ mole to 1 mole, and more preferably $1\times10^{-5}$ mole to $1\times10^{-1}$ mole per mole of silver halide or silver halide-forming component.

The sensitizing dye may be added at any stage during silver halide grain formation through completion of chemical sensitizaion.

In the invention, various organic silver salts may be used for increasing a sensitivity and improving a developability.

Examples of the organic silver salt usable in the invention are the silver salts of long-chain aliphatic carboxylic acids and carboxylic acids having heterocyclic ring such as silver behenate, silver α-(1-phenyltetrazolethio)-acetate, described in Japanese Patent O.P.I. Publication Nos. 4921/1978, 52626/1974, 141222/1977, 36224/1978, 37626/1978 and 37610/1978, and U.S. Pat. Nos. 3,330,633, 3,794,496 and 4,105,451; and the silver salts of imino groups described in Japanese Patent Examined Publication Nos. 26582/1969, 12700/1970, 18416/1970 and 22185/1970, Japanese Patent O.P.I. Publication Nos. 137321/1977, 118638/1983 and 118639/1983, and U.S. Pat. No. 4,123,274.

Preferred among the above organic silver salts are the silver salts of imino groups, particularly the silver salts of benzotriazole derivatives such as silver benzotriazole, silver 5-methylbenzotriazole, silver sulfobenzotriazole and silver N-alkylsulfamoylbenzotriazole.

The organic silver salt applicable to the invention may be used alone or in combination.

An addition amount thereof is preferably 0.01 mole to 500 moles, more preferably 0.1 mole to 100 moles, and most preferably 0.3 mole to 30 moles per mole of silver halide.

In the invention, a conventional reducing agent including a reducing agent precursor may be used.

Examples of the reducing agent usable in the invention are p-phenylenediamine and p-aminophenol developing agents, phosphoroamidephenol and sulfonamideaniline developing agents, hydrazone color developing agents and precursors thereof, phenols, sulfonamidephenols, polyhydroxybenzenes, naphthols, hydroxybinaphthyls, methylenebisnaphthols, methylenebisphenols, ascorbic acid, 3-pyrazolidones and pyrazolones described in U.S. Pat. Nos. 3,531,286, 3,761,270, 3,764,328, 3,342,599 and 3,719,492, Research Disclosure Nos. 12146, 15108 and 15127, Japanese Patent O.P.I. Publication Nos. 27132/1981, 135628/1978 and 79035/1982. A dye donor may be used also as a reducing agent.

The most preferred reducing agents are the N-(p-N,N-dialkyl) phenylsulfamates described in Japanese Patent O.P.I. Publication Nos. 146133/1981 and 727141/1987.

An addition amount thereof is 0.01 mole to 1500 moles, and more preferably 0.1 mole to 200 moles per mole of silver halide.

Examples of the binder used in the invention are synthetic or natural polymers including polyvinyl butyral, polyvinyl acetate, ethyl cellulose, polymethyl methacrylate, cellulose acetate-butyrate, polyvinyl alcohol, polyvinylpyrrolidone, gelatin and derivatives thereof, cellulose derivatives, proteins, starch and gum arabic. These compounds may be used alone or in combination, preferably in combination of gelatin or a derivative thereof with a hydrophilic polymer such as polyvinylpyrrolidone and polyvinyl alcohol, and more preferably in combination of gelatin with polyvinylpyrrolidone as described in Japanese Patent O.P.I. Publication No. 229556/1984.

The using amount of the binder is 0.05 g to 50 g, and preferably 0.2 g to 20 g per $m^2$ of the support.

The binder is used in an amount of preferably 0.lg to 10 g, and more preferably 0.2 g to 5 g per gram of the dye donor.

Examples of the support used in the invention are synthetic plastic films such as polyethylene film, cellulose acetate film, polyethylene terephthalate film and polyvinyl chloride film; paper supports such as photographic paper, printing paper, baryta paper and resin-coated paper; and supports prepared by coating and hardening an electron beam setting resin composition on these supports.

Where the heat-developable light-sensitive material of the invention is of a transfer type packaged with an image-receiving member, it is preferable to add a heat solvent to the heat-developable light-sensitive material and/or the image-receiving member. The heat solvent is liquid in heat developing and accelerates heat development and/or heat transfer. Examples thereof are the polar organic compounds described in U.S. Pat. Nos. 3,347675, 3,667,959, 3,438,776, 3,666,477 and 3,667,959; Research Disclosure No. 17643 (X II); and Japanese Patent O.P.I. Publication Nos. 229556/1984, 68730/1984, 84236/1984, 191251/1985, 232547/1985, 14241/1985, 52643/1986, 78554/1987, 42153/1987, 44737/1987, 19525/1976, 24829/1978, 60223/1978, 118640/1983 and 198038/1983. Those particularly useful for the invention are urea derivatives such as dimethylurea, diethylurea and phenylurea; amide derivatives such as acetamide, benzamide and p-toluamide; sulfonamide derivatives such as benzenesulfonamide and α-toluenesulfonamide; polyhydric alcohols such as 1,6-hexane-diol, 1,2-cyclohexane-diol and pentaerythritol; and polyethylene glycols.

Particularly preferred among the above heat solvents are water-insoluble heat solvents.

The layers to which a heat solvent is added are the light-sensitive silver halide emulsion layers, an intermediate layer, a protective layer, and an image-receiving layer of an image-receiving member.

The adding amount of the heat solvent is 10 to 500% by weight, and preferably 30 to 200% by weight of the binder.

The organic silver salt and heat solvent may be dispersed in the same liquid.

The heat-developable light-sensitive material of the invention may contain various additives such as a development accelerator, an antifoggant and a basic precursor, in addition to the above-mentioned components.

Examples of the development accelerator are the compounds described in Japanese Patent O.P.I. Publication Nos. 177550/1984, 111636/1984 and 124333/1984; the development accelerator-releasing compounds described in Japanese Patent O.P.I. Publication No. 159642/1986 and Japanese Patent Application No. 203908/1987; and the metallic ions having an electronegativity of 4 or more as described in Japanese Patent Application No. 104645/1988. These compounds may be used in combination.

Examples of the antifoggant are the higher fatty acids described in U.S. Pat. No. 3,645,739; the mercuric salts described in Japanese Patent Examined Publication No. 11113/1972; the N-halide compounds described in Japanese Patent O.P.I. Publication 47419/1976; the mercapto compound-releasing compounds described in U.S. Pat. No. 3,700,457 and Japanese Patent O.P.I. Publication No. 50725/1976; the arylsulfonic acids described in Japanese Patent O.P.I. Publication No. 125016/1974; the lithium carboxylates described in Japanese Patent O.P.I. Publication No. 47419/1976; the oxidation agents described in British Patent No. 1,455,271 and Japanese Patent O.P.I. Publication No. 101019/1975; the sulfinic acids and thiosulfonic acids described in Japanese Patent O.P.I. Publication No. 19825/1978; the 2-thiourasils described in Japanese Patent O.P.I. Publication No. 3223/1976; elemental sulfur described in Japanese Patent O.P.I. Publication No. 26019/1976; the disulfide and polysulfide compounds described in Japanese Patent O.P.I. Publication Nos. 42529/1976, 81124/1976 and 93149/1980; rosins and diterpenes described in Japanese Patent O.P.I. Publication No. 57435/1976; the polymer acids having a free carboxyl group or a sulfonic acid group described in Japanese Patent O.P.I. Publication No. 104338/1976; the thiazolinethione described in U.S. Pat. No. 4,138,265; 1,2,4-triazole and 5-mercapto-1,2,4-triazole described in Japanese Patent O.P.I. Publication No. 51821/1979 and U.S. Pat. No. 4,137,079; thiosulfinic esters described in Japanese Patent O.P.I. Publication No. 140883/1980; 1,2,3,4-thiatriazoles described in Japanese Patent O.P.I. Publication No. 142331/1980; the di-ortrihalogenated compounds described in Japanese Patent O.P.I. Publication Nos. 46641/1984, 57233/1984 and 57234/1984; the thiol compounds described in Japanese Patent O.P.I. Publication No. 111636/1984; the hydroquinone derivatives described in Japanese Patent O.P.I. Publication No. 198540/1985; and the combined use of hydroquinone derivatives and benzotriazole derivatives described in Japanese Patent O.P.I. Publication No. 227255/1985.

The other preferred antifoggants are the restrainers having a hydrophilic group described in Japanese Patent O.P.I. Publication No. 78554/1987; the polymer restrainers described in Japanese Patent O.P.I. Publication No. 121452/1987; and the restrainers having a ballast group described in Japanese Patent O.P.I. Publication No. 123456/1987.

In the invention, there may also be used a ballast group-having restrainer precursor, which is capable of releasing a ballast group-having restrainer in the course of development. Examples of the restrainer precursor are described in Japanese Patent Application No. 069994/1989.

The colorless couplers described in Japanese Patent Examined Publication No. 16239/1989 may also be used.

Examples of the basic precursor are a compound which is thermally decarboxylated to release a basic substance, such as guanidinium trichloroacetate, and a compound which is decomposed by intramolecular nucleophilic substitution reaction to release an amine, described in Japanese Patent O.P.I. Publication Nos. 130745/1981, 132332/1981, 157637/1984, 166943/1984, 180537/1984, 174830/1984, 195237/1984, 108249/1987 and 174745/1987; British Patent No. 2,079,480; and U.S. Pat. No. 4,060,420.

There are various other additives which may be added to the heat-developable light-sensitive material, such as an antihalation agent, a brightening agent, a hardening agent, an antistatic agent, a plasticizer, a coating aid, a matting agent, a surfactant and an antifading agent.

These additives may be added not only to the light-sensitive layers but also to non-light-sensitive layers such as an intermediate layer, a protective layer and a backing layer.

The heat-developable light-sensitive material of the invention contains (a) a light-sensitive silver halide, (b) a binder and (c) a dye donor. Further, the light-sensitive material may contain (d) an organic silver salt and (e) a reducing agent. The reducing agent can be a nucleophilic agent that causes a nucleophilic substitution reaction. Further, the reducing agent is preferably a color developing agent which acts as a nucleophilic agent.

These components may be contained basically in one heat-developable light-sensitive layer, but may not necessarily be contained in a single photographic component layer; for example, the heat-developable light-sensitive layer is divided into two layers and one of them contains the above components (a), (b), (d) and (e), while the other adjacent thereto contains a dye donor (c). The components may be incorporated independently into two or more layers as long as they can be integrative.

As described apove, the heat-developable light-sensitive layer may be divided into two or more layers such as low-sensitivity and high-sensitivity layers or high-density and low-density layers. Where the light-sensitive material is of full-color, generally it comprises three heat-developable light-sensitive layers of different sensitivities, and in the respective layers, the dyes of different color phases are formed or released by heat development.

In general, there is used a combination of a blue-sensitive layer for forming a yellow dye, a green-sensitive layer for a magenta dye and a red-sensitive layer for a cyan dye. A near infrared-sensitive layer may be combined with the above layers.

The construction of such layers may be discretionally determined according to purposes; in order a red-sensitive layer, a green-sensitive layer and a blue-sensitive layer on a support; in order a blue-sensitive layer, a green-sensitive layer and a red-sensitive layer on a support; and in order a green-sensitive layer, red-sensitive layer and a blue-sensitive layer on a support.

In addition to the above heat-developable light-sensitive layers, there may be provided the non-light-sensitive layers such as a subbing layer, an intermediate layer, a protective layer, a filter layer, a backing layer and a peeling layer. The heat-developable light-sensitive layers and non-light-sensitive layers are coated on a support by conventional methods.

The heat-developable light-sensitive material of the invention can be exposed with conventional light sources. Exposure time may be 1 second to 1/1000 sec. or shorter than 1/1000 sec.. A color filter may be used. The light-sensitive material of the invention can be subjected to a scanner exposure with a laser.

The exposed heat-developable light-sensitive material can be developed by heating at 80° C. to 200° C., preferably at 100° C. to 170° C. for a period of 1 second to 180 seconds, preferably 1.5 seconds to 120 seconds. The diffusible dye may be transferred to an image-receiving layer simultaneously with the heat development by contacting a light-sensitive layer with an image-receiving member. It may also be transferred by contacting the light-sensitive material with the image-receiving member after the heat development or after supplying water thereto and, if necessary, by further heating. Before exposure, preheating may be made at 70° C. to 180° C. The light-sensitive material and the image-receiving member may be subjected to preheating at 80° C. to 250° C. immediately before the heat-development/-transfer in order to bring them into closer contact with each other as described in Japanese Patent O.P.I. Publication Nos. 143338/1985 and 162041/1986.

The heat-developable light-sensitive material of the invention may be subjected to heating by various conventional means; for example, by contacting the light-sensitive material with a heated block or plate or with a heated roller or drum; by passing the material through a high-temperature atmosphere; by subjecting it to high-frequency heating; and by sending electric currency to a conductive layer provided on the back of the light-sensitive material or the image-receiving member and containing a conductive material such as carbon black. A heating pattern may be such as preheating and then reheating; heating in a short period at a high temperature or a long period at a low temperature; continuously increasing or lowering temperature or repeating it; and discontinuously heating. Exposure and heating may be carried out simultaneously.

The image-receiving layer of the image-receiving member has a function of accepting the dye released or formed in the heat-developable light-sensitive layer by heat development. There is used preferably the tertiary amine or quaternary amine salt-containing polymer described in U.S. Pat. No. 3,709,690. A typical diffusible transfer-type image-receiving layer is prepared by coating on a support a mixture of gelatin or polyvinyl alcohol with a polymer containing an ammonium salt or a tertiary amine. Another useful dye-receiving material is a heat-resistant organic high molecular material having a glass transition temperature of 40° C. to 250° C., described in Japanese Patent O.P.I. Publication No. 207250/1982.

The above polymer may be used either as an image-receiving layer or a support.

Also useful as the polymer are the synthetic polymers having a glass transition temperature of not less than 40° C. described in the Polymer Handbook 2nd ed. compiled by J. Brandrup, E. H. Immergut. Generally, the molecular weight of the above high molecular material is preferably 2,000 to 200,000. These high molecular materials may be used alone or in a blend, and may also be used in combination of two or more as a copolymer.

The most preferred examples of the image-receiving material are polyvinyl chloride described in Japanese Patent O.P.I. Publication No. 22342/1984 and polycarbonate containing a plasticizer described in Japanese Patent O.P.I. Publication No. 19138/1985.

These polymers may serve both as a support and an image-receiving layer. In this instance, the image-receiving member may be formed either of a single layer or plural layers.

The support for the image-receiving member may be either a transparent or opaque support, examples of which are films of polyethylene terephthalate, polycarbonate, polystyrene, polyvinyl chloride, polyethylene and polypropylene; and films thereof containing pigments such as titanium oxide, barium sulfate, calcium carbonate, and talc; baryta paper; resin coat paper prepared by laminating a pigment-containing thermoplastic resin on paper; cloths; glass plates; metal plates such as aluminum plates; supports prepared by coating and hardening a pigment-containing electron beam setting resin composition on the above supports; and supports prepared by providing a pigment-containing coat layer on the above supports. Also useful are various coat papers including the castcoat paper described in Japanese Patent O.P.I. Publication No. 283333/1987.

In addition, a support prepared by coating and hardening on a paper a pigment-containing electron beam-setting resin composition, and a support having on a paper a pigment coat layer and coated thereon an electron beam-setting resin composition can be used as an image-receiving member as it is because the resin layer itself can serve as an image-receiving layer.

The heat-developable light-sensitive material of the invention may be of a monosheet type having both light-sensitive layer and image-receiving layer on the same support as described in Reseach Disclosure No. 15108, Japanese Patent O.P.I. Publication Nos. 198458/1982, 207250/1982 and 80148/1986.

The heat-developable light-sensitive material of the invention has preferably a protective layer.

The protective layer may contain conventional additives.

EXAMPLES

The present invention is illustrated by the following examples and comparative examples.

EXAMPLE-1

1. Preparation of silver iodobromide emulsion

An equeous solution B 1000 ml containing KI 5.8 g and KBr 233.2 g and an aqueous solution C 1000 ml containing silver nitrate 2 moles and ammonia 4 moles were added simultaneously to a solution A dissolving osein gelatin 20 g and ammonia in ion-exchanged water 2000 ml at 56° C. with stirring by a stirrer described in Japanese Patent O.P.I. Publication 92523/1982 and 92524/1982, and maintaining pAg constant.

The configuration and size of the silver halide grains were adjusted by controlling pH, pAg and the adding speeds of Solutions B and C. There was prepared monodispersed silver iodobromide emulsion having a silver iodide content of 2 mole % and an average grain size of 0.24 μm. The emulsion was desalted, adjusted to pAg 6.8 at 40° C., and water was added to make the quantity thereof 1400 ml.

2. Preparation of a light-sensitive silver halide dispersion

To 700 ml of the above silver iodobromide emulsion were added in sequence the following components for chemical sensitization and spectral sensitization, whereby red-sensitive, green-sensitive and blue-sensitive silver halide emulsion dispersions were prepared. The chemical ripening temperature and time of each emulsion are shown below. To each dispersion were added 0.9 g of 4-hydroxy-6-methyl-1, 3,3a,7-tetrazaindene and 0.1 g of potassium bromide as the stabilizers upon completion of the chemical ripening.

| a) Preparation of red-sensitive silver iodobromide emulsion (Chemical ripening: 55° C., 90 minutes) | |
|---|---|
| Silver iodobromide emulsion | 700 ml |
| Gelatin | 32 g |
| Sodium thiosulfate | 12 mg |
| Potassium chloroaurate | 0.8 mg |
| Ammonium thiocyanate | 8.0 mg |
| Methanol solution containing 1 wt % of sensitizing dye (a) | 30 ml |
| Methanol solution containing 1 wt % of sensitizing dye (b) | 20 ml |
| Ion-exchanged water | 1230 ml |
| **b) Preparation of green-sensitive silver iodobromide emulsion (Chemical ripening: 55° C., 130 minutes)** | |
| Silver iodobromide emulsion | 700 ml |
| Gelatin | 32 g |
| Sodium thiosulfate | 15 mg |
| Potassium chloroaurate | 1.5 mg |
| Ammonium thiocyanate | 10 mg |
| Methanol solution containing 1 wt % of sensitizing dye (c) | 40 ml |
| Ion-exchanged water | 1240 ml |
| **c) Preparation of infrared-sensitive silver iodobromide emulsion Chemical ripening: 57° C., 180 minutes)** | |
| Silver iodobromide emulsion | 700 ml |
| 4-Hydroxy-6-methyl-1,3,3a,7-tetrazaindene | 0.13 g |
| Gelatin | 32 g |
| Methanol solution containing 0.1 wt % of sensitizing dye (d) | 40 ml |
| Methanol solution containing 0.1 wt % of sensitizing dye (e) | 60 ml |
| Sodium thiosulfate | 25 mg |
| Ion-exchanged water | 1180 ml |

Sensitizing dye (a)

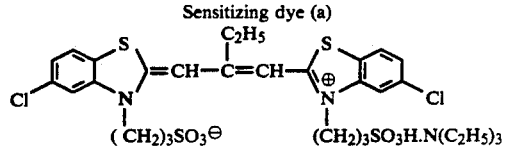

Sensitizing dye (b)

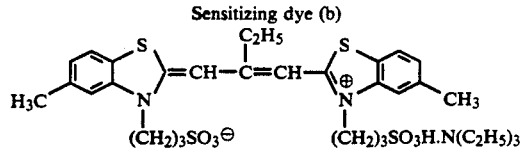

Sensitizing dye (c)

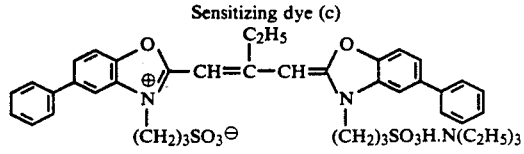

Sensitizing dye (d)

-continued

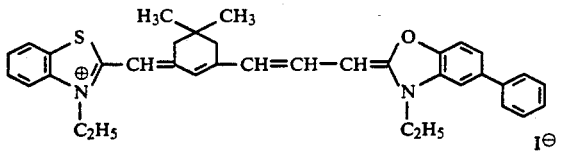

Sensitizing dye (e)

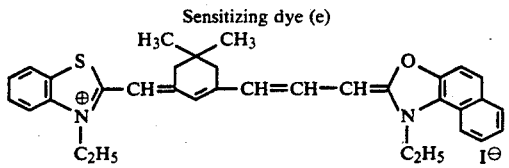

3. Preparation of organic silver salt dispersion

A mixture of 28.8 g of silver benzotriazole prepared by the reaction of benzotriazole with silver nitrate in a water-alcohol solvent, 4.0 g of poly-N-vinylpyrrolidone and 0.65 g of 5-methylbenzotriazole was dispersed by an alumina ball mill, adjusted to pH 5.5, to thereby prepare 200 ml of the dispersion.

4. Preparation of heat solvent dispersion-1

There were dispersed 25 g of the heat solvent-1 by an alumina ball mill in 100 ml of a 0.5% polyvinylpyrrolidone aqueous solution containing 0.04 g of the surfactant-1 to thereby prepare 120 ml of a dispersion.

Heat solvent-1

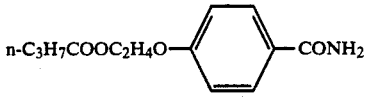

Surfactant-1

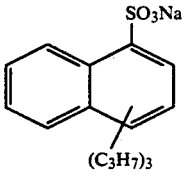

5.-(1) Preparation of dye donor dispersion-1

A solution of 35.5 g of the high-molecular dye donor (1) and 2.4 g of the antistain agent W-1 each dissolved in 200 ml of ethyl acetate and 15 ml of di-(2-ethylhexyl) phthalate was mixed with 124 ml of a 5 wt % Alkanol XC (product of DuPont) aqueous solution and 720 ml of a 6% gelatin aqueous solution, and the mixture was dispersed and emulsified by a ultrasonic homogenizer. After ethyl acetate was distilled off, the dispersion was adjusted to pH 5.5, whereby 795 ml of a dye donor dispersion-1 were prepared. Antistain agent W-1

Antistain agent W-1

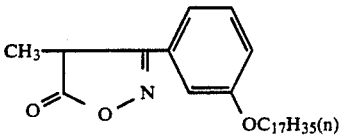

High-molecular dye donor (1)

-continued

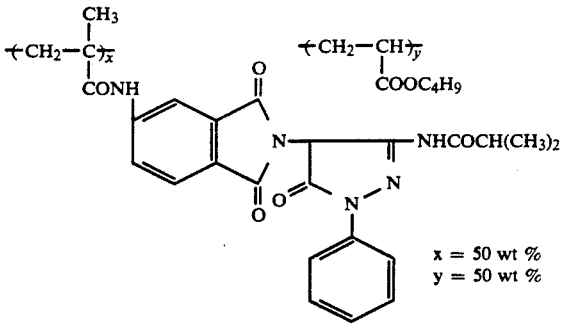

5.-(2) Dye donor dispersion-2

Dye donor dispersion-2 was prepared in the same manner as in dye donor dispersion-1 except that the dye donor was replaced by the high-molecular dye donor (2).

High-molecular dye donor (2)

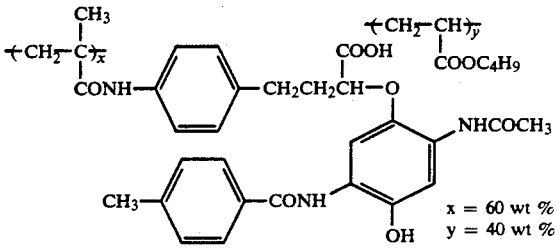

5.-(3) Dye donor dispersion-3

Dye donor dispersion-3 was prepared in the same manner as in dye donor dispersion-1 except that the dye donor was replaced by the high-molecular dye donor (3).

High-molecular dye donor (3)

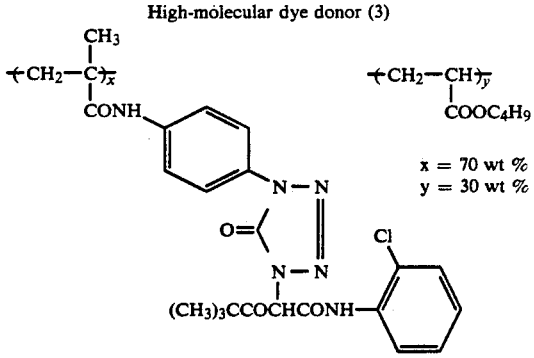

6. Preparation of reducinq aqent solution

There were dissolved in water, 20 g of the reducing agent R-1, 13.3 g of the reducing agent R-2, 14.6 g of poly(N-vinylpyrrolidone) and 0.50 g of the following fluorinnated surfactant, and the solution was adjusted to pH 5.5, whereby 250 ml of the reducing agent solution were prepared.

Reducing agent R-1

-continued

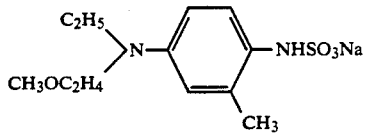

Reducing agent R-2

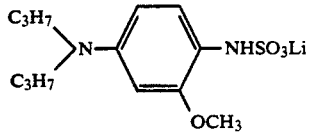

Surfactant

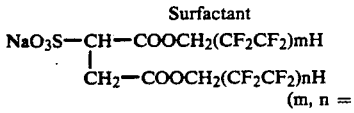

(m, n = 2 or 3)

coated to prepare a multilayer color light-sensitive material Sample 1 as shown in Table 1.

Layers 1 to 3 were coated simultaneously and dried on a support, and then Layers 4 to 7 were coated simultaneously as well.

The surfactant-3 was used as a coating aid for each of Layers 1 to 7, and there was added thereto the reaction product of tetrakis(vinylsulfonylmethyl)-methane and potassium taurine (molar ratio 1:0.75) as a hardening agent in an amount of 0.04 g per gram of gelatin.

Surfactant-3

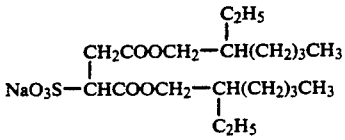

TABLE 1

| | | |
|---|---|---|
| Layer 7 | Protective layer | Gelatin 1.1 g, silica powder 0.20 g, heat solvent-1 0.75 g, UV absorber UV-1 0.2 g, reducing agent 0.7 g, polyvinylpyrrolidone 0.25 g, DOP 0.1 g, and antifoggant ST-1 0.002 g. |
| Layer 6 | Infrared-sensitive layer | Silver benzotriazole 0.61 g Ag, reducing agent 0.44 g, high-molecular dye donor(2) 1.0 g, infrared-sensitive silver halide emulsion 0.32 g Ag, gelatin 2.0 g, polyvinylpyrrolidone K-30 0.29 g, TCP 0.20 g, heat solvent-1 3.4 g, benzotriazole 0.02 g, sodium chloride 0.002 g, and antifoggant ST-1 0.01 g, DOP 0.28g. |
| Layer 5 | Second interlayer | Gelatin 1.3 g, polyvinylpyrrolidone K-30 0.28 g, filter dye F-1 0.40 g, reducing agent 0.2 g, oil-soluble brightening aqent 0.1 g DOP 0.2 g and antifoggant ST-1 0.003 g. |
| Layer 4 | Green-sensitive layer | Silver benzotriazole 0.29 g Ag, reducing agent 0.22 g, high-molecular dye donor(1) 0.58 g, TCP 0.12 g, antiirradiation dye-1 0.02 g, green-sensitive silver halide emulsion 0.27 g Ag, gelatin 1.9 g, polyvinylpyrrolidone 0.28 g, heat solvent-1 3.0 g, benzotriazole 0.02 g, sodium chloride 0.002 g, and antifoggant ST-1 0.006 g, DOP 0.14 g. |
| Layer 3 | First interlayer | Gelain 1.4 g, reducing agent 0.24 g, UV-1 0.2 g, polyvinylpyrrolidone 0.15 g, DOP 0.1 g and antifoggrant ST-1 0.003 g. |
| Layer 2 | Red-sensitive layer | Silver benzotriazole 0.72 g Ag, reducing agent 0.35 g, high-molecular dye donor(3) 1.0 g, TCP 0.20 g, red-sensitive silver halide emulsion 0.36 g Ag, gelatin 2.0 g, antiirradiation agent-2 0.02 g, polyvinylpyrrolidone K-30 0.21 g, heat solvent-1 3.0 g, benzotriazole 0.02 g, sodium chloride 0.002 g, and antifoggrant ST-1 0.01 g, DOP 0.28 g. |
| Layer 1 | Gelatin layer | Gelatin 1.2 g, heat solvent-1 1.0 g, and reducing agent 0.2 g. |
| Support | | 100 μm-thick transparent polyethylene terephthalate film subbed with latex. |

DOP: di-(2-ethylhexyl)-phthalate
TCP: tricresyl phosphate

7. Preparation of li gght-sensitive material Sample 1

The above prepared ogranic silver salt dispersion, silver halide emulsion and dye donor dispersion were The added amount of each component is per $m^2$ except that those of the silver halide and silver benzotriazole are in silver equivalent.

Each layer contains a surfactant as a coating aid and a hardening agent.

ST-1

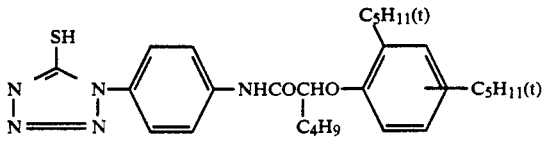

-continued

F-1

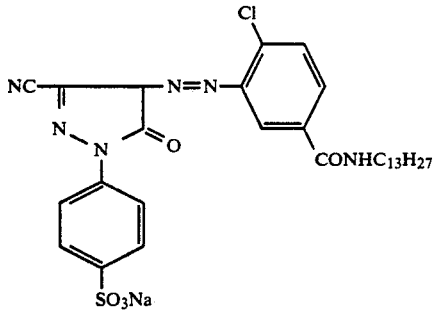

UV-1

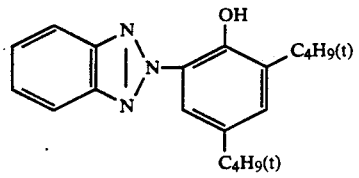

Antiirradiation dye-1

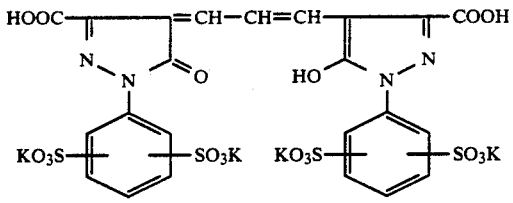

Oil-soluble brightening agent

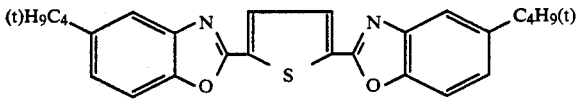

(UVITEX OB, product of Ciba Geigy)

Antiirradiation dye-2

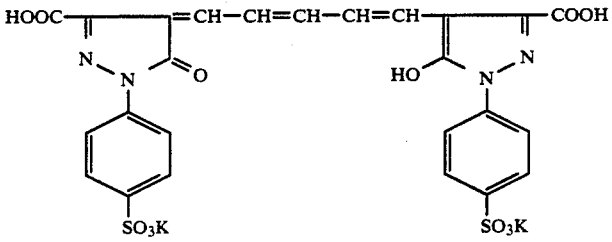

8. Preparation of light-sensitive material Samples 2 to 6 (Comparative samples)

Light-sensitive material Samples 2 to 6 were prepared in the same manner as in Sample 1 except that the development accelerators given in Table 2 were added in a methanol solution.

TABLE 2

| Sample No. | Development accelerator | Added amount ($\mu$ mole/m$^2$) Layer 2 | Layer 3 | Layer 4 | Layer 5 | Layer 6 | Layer 7 |
|---|---|---|---|---|---|---|---|
| 2 | DA-1 | 61 | — | 29 | — | 72 | — |
| 3 | DA-1 | — | 74 | — | 53 | — | 35 |
| 4 | DA-1 | 47 | 9 | 24 | 13 | 59 | 10 |
| 5 | DA-2 | 122 | — | 58 | — | 143 | — |

TABLE 2-continued

| Sample No. | Development accelerator | Added amount (μ mole/m²) Layer 2 | Layer 3 | Layer 4 | Layer 5 | Layer 6 | Layer 7 |
|---|---|---|---|---|---|---|---|
| 6 | DA-3 | 61 | — | 29 | — | 72 | — |

DA-1

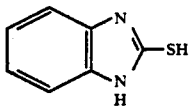

DA-2

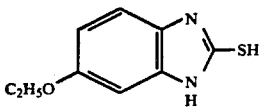

DA-3

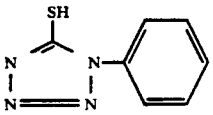

9. Preparation of light-sensitive material Samples 101 to 117 (Samples of the invention)

Light-sensitive material Samples 101 to 117 were prepared in the same manner as in Sample 1 except that the development accelerator precursors shown in Table 3 were added.

Each of the development accelerator precursors was added in a dispersion prepared as follows:

Preparation of development accelerator precursor dispersion

A solution of 1.0 g of the development accelerator precursor dissolved in 40 ml of ethyl acetate, 0.4 g of tricresyl phosphate and, if necessary, a small amount of dimethylformamide, was mixed with 15 ml of a 5 wt % Alkanol XC (product of Dupont) aqueous solution and 80 ml of a 4% gelatin aqueous solution, and the mixture was dispersed and emulsified by an ultrasonic homogenizer, followed by distilling off ethyl acetate, whereby a development accelerator precursor dispersion was prepared.

10. Preparation of image-receiving member

An image-receiving member was prepared by forming on a photographic baryta paper a polyvinyl chloride layer image-receiving layer) containing the following compounds TP-1 and AC-1.

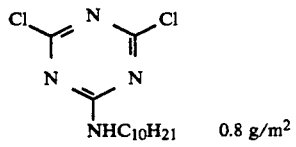

TP-1

$NHC_{10}H_{21}$ 0.8 g/m²

$HOCH_2CH_2SCH_2CH_2SCH_2CH_2OH_2$ 0.2 g/m² AC-1

Color development

Each of the light-sensitive material Samples 101 to 117 was exposed through a step wedge to red, green and infrared monochromatic light, and superposed on the image-receiving member, and then subjected to heat development at 145° C. for 60 seconds. Afterwards, the image-receiving member was peeled off from the light-sensitive material, whereby there were formed on the image-receiving member the cyan, magenta and yellow dye images, which are indicated with R, G and B in Table 3(B).

Evaluation of photoqraphic characteristics

The densities of the dye images were measured with a reflection densitometer PDA-65 manufactured by KONICA Corporation, to measure the maximum densities (Dmax) and the minimum densities (Dmin) thereof. The results are shown in Table 3(B).

As is apparent from Table 3, the samples of the invention containing the development accelerator precursors of the invention have Dmax which can be increased with little increased Dmin, and can provide an image having an excellent discrimination.

TABLE 3(A)

| Sample No. | Development accelerator precursor | Added amount μ mole/m²) Layer 2 | Layer 3 | Layer 4 | Layer 5 | Layer 6 | Layer 7 |
|---|---|---|---|---|---|---|---|
| 101 | IV-2 | 61 | — | 29 | — | 72 | — |
| 102 | IV-2 | 47 | 9 | 24 | 13 | 59 | 10 |
| 103 | IV-10 | 61 | — | 29 | — | 72 | — |
| 104 | IV-10 | — | 74 | — | 53 | — | 35 |
| 105 | IV-10 | 47 | 9 | 24 | 13 | 59 | 10 |
| 106 | IV-10 | 122 | — | 58 | — | 143 | — |
| 107 | IV-11 | 122 | — | 58 | — | 143 | — |
| 108 | IV-14 | 122 | — | 58 | — | 143 | — |
| 109 | IV-15 | 122 | — | 58 | — | 143 | — |
| 110 | IV-16 | 61 | — | 29 | — | 72 | — |

TABLE 3(A)-continued

| Sample No. | Development accelerator precursor | Added amount μ mole/m²) Layer 2 | Layer 3 | Layer 4 | Layer 5 | Layer 6 | Layer 7 |
|---|---|---|---|---|---|---|---|
| 111 | IV-21 | 61 | — | 29 | — | 72 | — |
| 112 | II-3 | 31 | — | 15 | — | 36 | — |
| 113 | II-14 | 31 | — | 15 | — | 36 | — |
| 114 | III-2 | 61 | — | 29 | — | 72 | — |
| 115 | II-18 | 31 | — | 15 | — | 36 | — |
| 116 | IV-31 | 61 | — | 29 | — | 72 | — |
| 117 | IV-26 | 31 | — | 15 | — | 36 | — |

TABLE 3(B)

| Sample No. | | Minimum density (Dmin) Light for measurement B | G | R | Maximum density (Dmax) B | G | R |
|---|---|---|---|---|---|---|---|
| 1 | (Comparative) | 0.10 | 0.09 | 0.06 | 1.27 | 1.50 | 1.53 |
| 2 | " | 0.28 | 0.31 | 0.19 | 1.59 | 1.87 | 1.88 |
| 3 | " | 0.23 | 0.24 | 0.17 | 1.51 | 1.80 | 1.83 |
| 4 | " | 0.26 | 0.28 | 0.18 | 1.55 | 1.82 | 1.83 |
| 5 | " | 0.23 | 0.22 | 0.17 | 1.47 | 1.80 | 1.79 |
| 6 | " | 0.35 | 0.42 | 0.32 | 1.71 | 1.94 | 1.92 |
| 101 | (Invention) | 0.11 | 0.09 | 0.06 | 1.70 | 2.05 | 2.02 |
| 102 | " | 0.10 | 0.08 | 0.05 | 1.66 | 1.98 | 1.96 |
| 103 | " | 0.11 | 0.09 | 0.06 | 1.74 | 2.13 | 2.15 |
| 104 | " | 0.10 | 0.09 | 0.05 | 1.68 | 2.04 | 1.98 |
| 105 | " | 0.10 | 0.08 | 0.06 | 1.70 | 2.08 | 2.01 |
| 106 | " | 0.12 | 0.11 | 0.07 | 1.77 | 2.26 | 2.24 |
| 107 | " | 0.10 | 0.10 | 0.06 | 1.72 | 2.15 | 2.13 |
| 108 | " | 0.09 | 0.10 | 0.06 | 1.65 | 1.92 | 1.94 |
| 109 | " | 0.09 | 0.09 | 0.05 | 1.49 | 1.76 | 1.77 |
| 110 | " | 0.10 | 0.09 | 0.06 | 1.48 | 1.75 | 1.71 |
| 111 | " | 0.13 | 0.13 | 0.09 | 1.62 | 1.88 | 1.94 |
| 112 | " | 0.13 | 0.14 | 0.09 | 1.61 | 1.85 | 1.92 |
| 113 | " | 0.17 | 0.16 | 0.12 | 1.68 | 1.95 | 2.00 |
| 114 | " | 0.11 | 0.12 | 0.07 | 1.52 | 1.78 | 1.81 |
| 115 | " | 0.15 | 0.15 | 0.12 | 1.67 | 1.93 | 1.95 |
| 116 | " | 0.11 | 0.11 | 0.06 | 1.67 | 1.95 | 1.90 |
| 117 | " | 0.13 | 0.14 | 0.10 | 1.65 | 1.89 | 1.96 |

EXAMPLE-2

The light-sensitive material Samples 1, 2, 5, 101, 103 and 107 in Example-1 were subjected to accelerated aging tests for three days under the conditions of 50° C. and 80% RH, and then exposed and processed in the same manner as in Example 1. The sensitivities of the samples before and after the accelerated aging tests were measured. The sensitivity is the reciprocal of an exposure that gives a reflection density of the minimum density (Dmin)+0.5, and is given in Table 4 in terms of a value relative to the sensitivity set at 100 of the light-sensitive material Sample 1.

As can be found from Table 4, Samples 2 and 5, to which were added the development accelerators, show significant drop of the sensitivities after the accelerated aging test, while Samples 101, 103 and 107 containing the development accelerator precursors of the invention show less drop of the sensitivities attributable to the accelerated aging test.

TABLE 4

| Sample No. | | Before accelerate aging test Exp. light R | G | IR | After 3-day aging at 50° C., 80% RH R | G | IR |
|---|---|---|---|---|---|---|---|
| | | Light for measurement B | G | R | B | G | R |
| 1 | (Comparative) | 100 | 100 | 100 | 35 | 27 | 59 |
| 2 | " | 120 | 115 | 126 | 49 | 38 | 80 |
| 5 | " | 117 | 112 | 120 | 54 | 44 | 77 |
| 101 | (Invention) | 141 | 135 | 145 | 93 | 87 | 107 |
| 103 | " | 158 | 148 | 166 | 109 | 100 | 129 |
| 107 | " | 135 | 132 | 151 | 98 | 93 | 120 |

EXAMPLE-3

The light-sensitive material Samples 1, 2 and 103 in Example 1 were exposed in the same manner as in Example 1, and contacted with the same image-receiving member as that of Example-1 to be subjected to heat developing at 145° C. for 60, 70 and 80 seconds. After the development, the image densities were measured in the same manner as in Example-1. The results are shown in Table 5.

As is apparent from Table 5, the light-sensitive materials of the invention can form images of which maximum densities Dmax and minimum densities Dmin are less affected by changes in the developing conditions.

TABLE 5

| Sample No. | Dev. time (sec) | Minimum density (Dmin) B | G | R | Maximum density (Dmax) B | G | R |
|---|---|---|---|---|---|---|---|
| 1 | 60 | 0.10 | 0.09 | 0.06 | 1.27 | 1.50 | 1.53 |
| (Comparative) | 70 | 0.25 | 0.21 | 0.14 | 1.42 | 1.63 | 1.69 |
| | 80 | 0.43 | 0.39 | 0.25 | 1.65 | 1.90 | 1.94 |
| 2 | 60 | 0.28 | 0.31 | 0.19 | 1.59 | 1.87 | 1.88 |
| (Comparative) | 70 | 0.38 | 0.40 | 0.28 | 1.77 | 2.09 | 2.11 |
| | 80 | 0.52 | 0.57 | 0.40 | 1.97 | 2.31 | 2.31 |
| 103 | 60 | 0.11 | 0.09 | 0.06 | 1.74 | 2.13 | 2.15 |
| (Invention) | 70 | 0.14 | 0.13 | 0.08 | 1.81 | 2.24 | 2.24 |
| | 80 | 0.21 | 0.18 | 0.13 | 1.96 | 2.38 | 2.40 |

EXAMPLE-4

Light-sensitive material Sample 201 was prepared in the same manner as Sample 1 of Example-1 except that the high-molecular dye donors (1), (2) and (3) were replaced by the following DDR-1, DDR-2 and DDR-3, respectively.

DDR-1

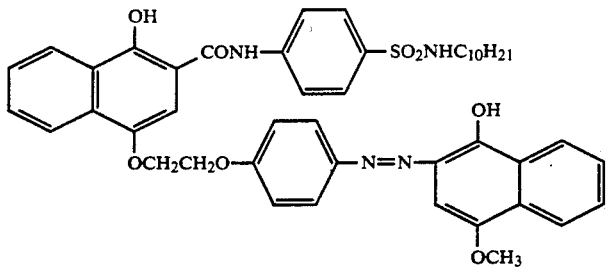

DDR-2

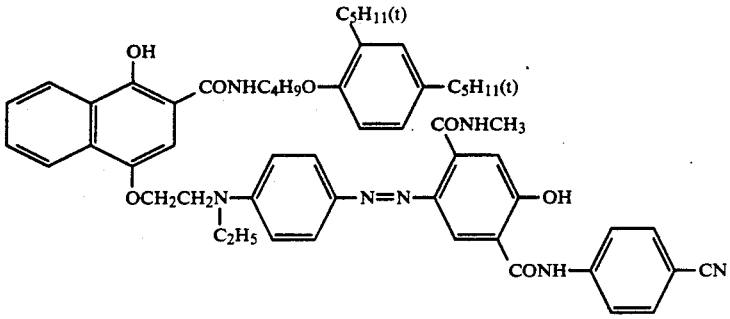

DDR-3

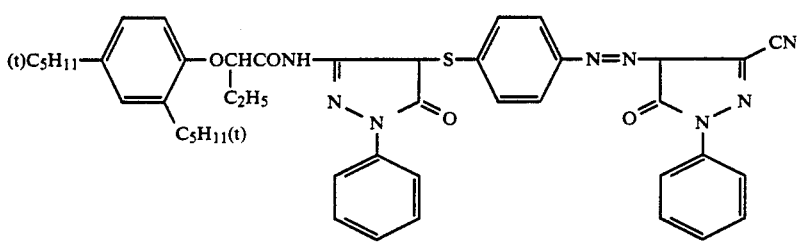

Further, light-sensitive material Samples 202 to 205 were prepared in the same manner as Sample 201 except that the development accelerator precursors listed in Table 6 were incorporated in an amount of 26μ moles/m² into Layer 2, 13μ moles/m² into Layer 4, and 31μ moles/m² into Layer 6.

The above samples were exposed and developed in the same manner as in Example-1, and Dmin and Dmax were measured.

The results are shown in Table 6.

As is apparent from Table 6, Samples 202 to 205 of the invention containing the development accelerator precursors of the invention can provide more increased maximum densities with little increased minimum densities and more excellent image discrimination than the comparative Sample 201.

The light-sensitive materials of the invention can form images having good discrimination even after 3 days aging under the 50° C./80% RH conditions, which indicates that the light-sensitive materials of the invention have an excellent preservability.

TABLE 6

| Sample No. | Development accelerator precursor | Minimum density (Dmin) | | | Maximum density (Dmax) | | |
|---|---|---|---|---|---|---|---|
| | | B | G | R | B | G | R |
| 201 (Comp.) | — | 0.15 | 0.12 | 0.09 | 1.21 | 1.48 | 1.39 |
| 202 (Inv.) | IV-2 | 0.16 | 0.14 | 0.10 | 1.54 | 1.81 | 1.68 |
| 203 (Inv.) | IV-10 | 0.15 | 0.13 | 0.09 | 1.58 | 1.87 | 1.72 |
| 204 (Inv.) | IV-11 | 0.16 | 0.12 | 0.09 | 1.50 | 1.73 | 1.62 |
| 205 (Inv.) | IV-20 | 0.14 | 0.12 | 0.08 | 1.45 | 1.69 | 1.56 |

EXAMPLE-5

Light-sensitive material Samples 301 to 317 were prepared with the following dye donor dispersion, and the image-receiving member-2 was also prepared.

Dye donor dispersion

A solution of 30.0 g of the following dye donor DRR-1 dissolved in 30.0 g of tricresyl phosphate and 90.0 ml of ethyl acetate was mixed with 460 ml of a gelatin aqueous solution containing the same surfactant as in Example-1, and dispersed by a ultrasonic homogenizer. Then, ethyl acetate was distilled off, and water was added to make the total quantity 500 ml.

Dye donor DRR-1

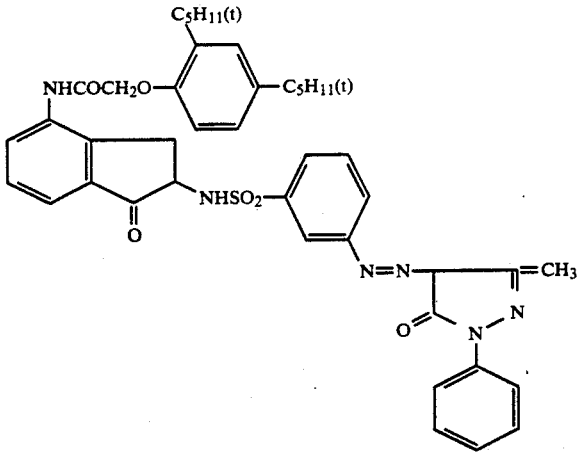

Preparation of heat-developable light-sensitive material

Sample 301

| | |
|---|---|
| Green-sensitive silver halide emulsion in Example 1 | 40.0 ml |
| Organic silver salt dispersion in Example-1 | 25.0 ml |
| Dye donor dispersion | 50.0 ml |
| Heat solvent-2 | 5 g |
| 1-Phenyl-4,4'-dimethyl-3-pyrazolidone (10 wt % methanol solution) | 1.5 ml |
| Hardener in Example-1 | 3.0 ml |
| Guanidine trichloroacetate (10 wt % water-alcohol solution) | 20.0 ml |

A mixture of the above components was coated on a subbed polyethylene terephthalate film of 180 μm thickness in a coated silver amount of 2.50 g/m$^2$, and the antifoggant ST-1 was added in an amount of 14.9mg/m$^2$ Heat solvent-2

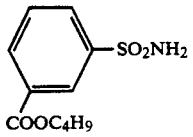

Preparation of heat-developable light-sensitive material

Samples 302 to 307

Light-sensitive material Samples 302 to 307 were prepared in the same manner as Sample 301 except that the development accelerators or precursors thereof listed in Table 7 were added.

Preparation of image-receiving member-2

The following layers were coated in sequence on a 100 μm-thick transparent polyethylene terephthalate film.

Layer 1 composed of polyacrylic acid: 7.00 g/m$^2$

Layer 2 composed of cellulose acetate: 4.00 g/m$^2$

Layer 3 composed of a copolymer of styrene and N-benzyl-N, N-di-methyl-N-(3-maleimidopropyl)ammonium chloride (1:1), and gelatin: copolymer 3.00 g/m$^2$, gelatin 3.00 g/m$^2$ Layer 4 composed of urea and polyvinyl alcohol (saponification rate 98%): urea 4.0 g/m$^2$, polyvinyl alcohol 3.0 g/m$^2$ Processing and evaluation Each of the above light-sensitive samples was exposed through a stepwedge to a green light and contacted with the above image receiving member-2 for heat development at 150° C. for 1 minute in a heat processor, and then the image-receiving member was quickly peeled off. The transmission density of the transparent green image formed on the image-receiving element surface was measured with a densitometer PDA-65 manufactured by KONICA Corporation. The maximum densities Dmax and the minimum densities (fog) Dmin are shown in Table 7.

As is apparent from Table 7, the light-sensitive material samples of the invention containing the development accelerator precursor of the invention can provide more increased maximum densities Dmax with little increased minimum densities Dmin and more excellent image discrimination than the comparative Sample 301.

TABLE 7

| | Development accelerator or precursor thereof | | Minimum | Maximum |
|---|---|---|---|---|
| Sample No. | Type | Amt (μ mol/m$^2$) | density (Dmin) | density Dmax) |
| 301 (Comparative) | — | — | 0.15 | 0.99 |
| 302 (Comparative) | DA-1 | 160 | 0.26 | 1.24 |
| 303 (Invention) | IV-10 | 160 | 0.15 | 1.42 |
| 304 (Invention) | IV-11 | 200 | 0.14 | 1.39 |
| 305 (Invention) | IV-23 | 60 | 0.18 | 1.35 |
| 306 (Invention) | II-18 | 40 | 0.17 | 1.48 |
| 307 (Invention) | III-13 | 160 | 0.15 | 1.27 |

EXAMPLE-6

Light-sensitive material Samples No. 118 to 124 were prepared and evaluated in the same manner as in Sample No. 1 of Example 1, except that there were added the development accelerator precursors II-21 and II-22 and comparative compounds RC-1 to 5 as shown in Table 8. The results are shown in Table 9.

RC-1

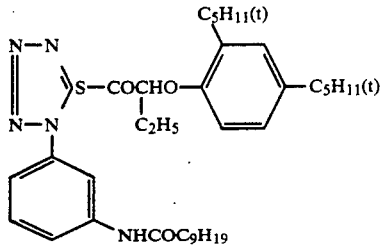

RC-2

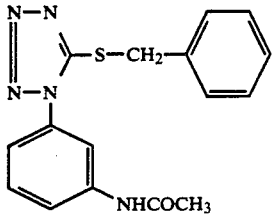

RC-3

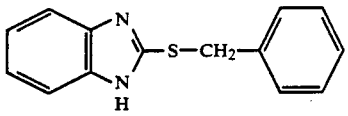

RC-4

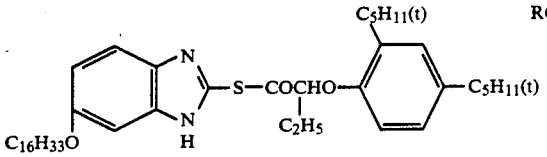

RC-5

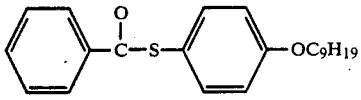

TABLE 8

| Sample No. | Development accelerator precursor | Added amount (μ mole/m²) Layer 2 | Layer 3 | Layer 4 | Layer 5 | Layer 6 | Layer 7 |
|---|---|---|---|---|---|---|---|
| 118 | II-21 | 31 | — | 15 | — | 36 | — |
| 119 | II-22 | 31 | — | 15 | — | 36 | — |
| 120 | RC-1 | 31 | — | 15 | — | 36 | — |
| 121 | RC-2 | 31 | — | 15 | — | 36 | — |
| 122 | RC-3 | 61 | — | 29 | — | 72 | — |
| 123 | RC-4 | 61 | — | 29 | — | 72 | — |
| 124 | RC-5 | 61 | — | 29 | — | 72 | — |

TABLE 9

| Sample No. | | Minimum density (Dmin) Light for measurement B | G | R | Maximum density (Dmax) B | G | R |
|---|---|---|---|---|---|---|---|
| 1 | (Comparative) | 0.10 | 0.09 | 0.06 | 1.27 | 1.50 | 1.53 |
| 101 | (Invention) | 0.11 | 0.09 | 0.06 | 1.70 | 2.05 | 2.02 |
| 112 | " | 0.13 | 0.13 | 0.09 | 1.62 | 1.88 | 1.94 |
| 118 | " | 0.12 | 0.11 | 0.08 | 1.56 | 1.79 | 1.81 |
| 119 | " | 0.11 | 0.11 | 0.07 | 1.44 | 1.70 | 1.73 |
| 120 | (Comparative) | 0.10 | 0.09 | 0.06 | 1.31 | 1.57 | 1.59 |
| 121 | " | 0.12 | 0.10 | 0.08 | 1.34 | 1.58 | 1.58 |
| 122 | " | 0.11 | 0.10 | 0.06 | 1.35 | 1.61 | 1.58 |
| 123 | " | 0.09 | 0.09 | 0.05 | 1.25 | 1.46 | 1.52 |
| 124 | " | 0.22 | 0.19 | 0.16 | 1.39 | 1.60 | 1.62 |

The light-sensitive materials of the invention provide the images with improved discriminations, while the comparative light-sensitive materials provide the images with unchanged or even deteriorated discriminations.

What is claimed is:

1. A heat developable color light-sensitive material comprising a support having thereon at least a light-sensitive silver halide, a binder, a dye donor, and a compound represented by following Formula I:

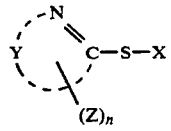

wherein X represents an acyl group, an alkoxycarbonyl group, an aryloxycarbonyl group, a sulfonyl group, a carbamoyl group, an N-substituted carbamoyl group, a thicarbonyl group, a thiocarbamoyl group, an N-substituted thiocarbamoyl group, —SR, —COSR, in which R represents an alkyl group, an aryl group, a cycloalkyl group, or a heterocyclic residue Y represents the group of atoms necessary to form 5- or 6-membered heterocyclc ring; Z represents a halogen atom, a hydroxy group, a mercapto group, a sulfamoyl group, an amino group, or an organic group having carbon atoms of not more than 13; and n represents an integer of 0 to 4.

2. The heat-developable color light-sensitive material of claim 1, wherein R represents

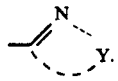

3. The heat-developable color light-sensitive material of claim 1, wherein Y represents said heterocylic ring which is condensed with a hydrocarbon ring or a second heterocyclic ring.

4. The material of claim 1, wherein X has a ballast group.

5. The material of claim 4, wherein the ballast group is an alkyl group which is selected so that the total carbonb atoms contained in X are 13 to 40.

6. The material of claim 1, wherein the organic group is an alkyl group, an aryl group, an alkoxy group, an aryloxy group, an alkylthio group, an arylthio group, an acyl group, an alkoxycarbonyl group, an N-substituted amino group, an acylamino group, a carbamoyl group, an N-substituted carbamoyl group, an alkylsulfonyl group, an arylsulfonyl group, an alkylsulfonylamino group, an arylsulfonylamino group, or a cyano group.

7. The material of claim 1, wherein the compound is represented by Formula II, III or IV:

Formula II

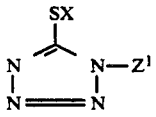

Formula III

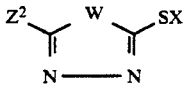

-continued

Formula IV

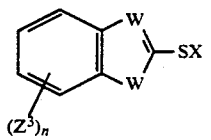

wherein X and n are the same as those defined in Formula I; $Z^1$, $Z^2$ and $Z^3$ are the same as those defined for Z in Formula I; and W represents an oxygen atom, a sulfur atom or an imino group.

8. The material of claim 7, wherein $Z^1$ is

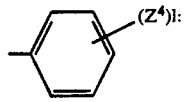

wherein $Z^4$ represents a hydrogen atom, a halogen atom, an alkyl group, an alkoxy group, an aryloxy group, an alkylthio group, an arylthio group, an acyl group, an alkoxycarbonyl group, an N-substituted amino group, an acylamino group, a carbamoyl group, an N-substituted carbamoyl group, an alkylsulfonyl group, an arylsulfonyl group, an alkylsulfonylamino group, an arylsulfonylamino group, a sulfamoyl group, a cyano group, or a carboxyl group; and l is an integer of 0 to 4.

9. The material of claim 7, wherein the carbon atoms contained in $Z^2$ or $Z^3$ are not more than 7.

10. The material of claim 9, wherein the carbon atoms are not more than 5.

11. The material of claim 7, wherein the carbon atoms contained in $Z^4$ are not more than 5.

12. The material of claim 7, wherein the compound is represented by Formula IV.

13. The material of claim 7, wherein an addition amount of the compound is 0.1 milimole to 2 mole per mole of silver halide.

14. The material of claim 13, wherein the addition amount is 1 milimole to 200 milimole per mole of silver halide.

15. The material of claim 13, wherein the compound is a development accelerator precursor.

16. The material of claim 15, wherein the development accelerator precursor releases a development accelerator upon a nucleophilic reaction in heat development.

17. The material of claim 16, wherein the nucleophilic reaction is initiated by a nucleophilic agent having an amino group.

18. The material of claim 17, wherein the nucleophilic agent is a color developing agent.

19. The material of claim 1, wherein the dye donor is a compound capable of forming a diffusible dye upon a coupling reaction

20. The materia of claim 1, futher containing a sensitizing dye, an organic silver salt and a reducing agent.

21. The material of claim 1, being packaged with an image-receiving member.

22. The material of claim 21, wherein a heat-solvent is contained in at least one of the heat-developable material and the image-receiving member.

23. The material of claim 16, wherein the heat development is carried out at a temperature of 80° to 200° C.

24. The material of claim 23, wherein the temperature is 100° to 170° C.

25. The material of claim 23, wherein the heat development is carried out over a period of 1 to 180 seconds.

26. The material of claim 25, wherein the period is 1.5 to 120 seconds.

27. The material of claim 15, wherein a silver salt of the development accelerator has a solubility product of not more than $10^{-8}$ in water of 25° C. and pH 9.6.

28. The material of claim 27, wherein the solubility product is not more than $10^{-10}$.

* * * * *

UNITED STATES PATENT AND TRADEMARK OFFICE

CERTIFICATE OF CORRECTION

PATENT NO. : 5,084,376

DATED : January 28, 1992

INVENTOR(S) : Yoshihiko Suda et al

It is certified that error appears in the above-identified patent and that said Letters Patent is hereby corrected as shown below:

Claim 1, column 44, line 19, change "thicarbonyl" to --thiocarbonyl--.

Claim 5, column 44, line 46, change "carbonb" to --carbon--.

Claim 7, column 45, line 5, change "

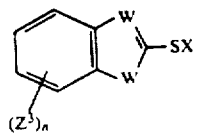

"

to --

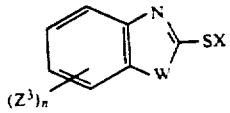

--.

UNITED STATES PATENT AND TRADEMARK OFFICE

CERTIFICATE OF CORRECTION

PATENT NO. : 5,084,376

DATED : January 28, 1992

INVENTOR(S) : Yoshihiko Suda et al

It is certified that error appears in the above-identified patent and that said Letters Patent is hereby corrected as shown below:

Claim 19, column 46, line 20, after "reaction" insert --.--.

Claim 20, column 46, line 21, change "materia" to --material--.

Signed and Sealed this

Fifth Day of October, 1993

*Attest:*

*Attesting Officer*

BRUCE LEHMAN

*Commissioner of Patents and Trademarks*